US012241030B2

(12) United States Patent
Bhowmik et al.

(10) Patent No.: US 12,241,030 B2
(45) Date of Patent: Mar. 4, 2025

(54) ADDITIZED DME/LPG FUEL FOR IMPROVING COMBUSTION EFFICIENCY

(71) Applicant: INDIAN OIL CORPORATION LIMITED, Maharashtra (IN)

(72) Inventors: Koushik Bhowmik, Faridabad (IN); Ruchi Jain, Faridabad (IN); Jyotiranjan Ota, Faridabad (IN); Samik Kumar Hait, Faridabad (IN); Chandrasekaran Kannan, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 18/381,004

(22) Filed: Oct. 17, 2023

(65) Prior Publication Data

US 2024/0124793 A1 Apr. 18, 2024

(30) Foreign Application Priority Data

Oct. 17, 2022 (IN) ..... 202221059184

(51) Int. Cl.
*C10L 1/12* (2006.01)

(52) U.S. Cl.
CPC ..... *C10L 1/1233* (2013.01); *C10L 1/1208* (2013.01); *C10L 2200/024* (2013.01); *C10L 2200/0245* (2013.01); *C10L 2200/029* (2013.01); *C10L 2230/22* (2013.01)

(58) Field of Classification Search
CPC ..... C10L 1/1233; C10L 1/1208; C10L 2200/024; C10L 2200/0245; C10L 2200/029; C10L 2230/22; C10L 2200/0204; C10L 2200/0209; C10L 2200/0218; C10L 2200/0231; C10L 2200/0236; C10L 2200/0254; C10L 2200/0407; C10L 2250/06; C10L 2270/08; C10L 3/12; C10L 3/003
See application file for complete search history.

(56) References Cited

U.S. PATENT DOCUMENTS

| | | | | |
|---|---|---|---|---|
| 5,782,936 | A * | 7/1998 | Riley | C10L 3/12 44/443 |
| 11,603,503 | B2 * | 3/2023 | Bhowmik | C10L 1/14 |
| 12,037,554 | B2 * | 7/2024 | Bhowmik | C10L 10/02 |
| 2004/0244279 | A1 * | 12/2004 | Briscoe | C10L 3/10 44/438 |
| 2007/0180760 | A1 * | 8/2007 | Zhou | B01J 35/393 44/354 |
| 2009/0000186 | A1 | 1/2009 | Sanders et al. | |
| 2010/0281764 | A1 * | 11/2010 | Bollon | F17C 11/007 44/448 |
| 2011/0010986 | A1 * | 1/2011 | Alarco | C10L 1/1233 44/357 |
| 2015/0148216 | A1 | 5/2015 | Nazarpoor et al. | |
| 2018/0171249 | A1 * | 6/2018 | Fridman | F17C 11/007 |
| 2019/0276760 | A1 * | 9/2019 | Ota | C10L 1/301 |
| 2020/0283690 | A1 * | 9/2020 | Janjua | C10L 10/16 |
| 2022/0372386 | A1 * | 11/2022 | Bhowmik | C10L 3/003 |
| 2024/0010922 | A1 * | 1/2024 | Littlewood | B01J 29/7415 |

FOREIGN PATENT DOCUMENTS

| | | | |
|---|---|---|---|
| EP | 3 553 155 | A1 | 10/2019 |
| WO | 2004/065529 | A1 | 8/2004 |
| WO | 2010/072999 | A2 | 7/2010 |

OTHER PUBLICATIONS

Tao et al., Understanding complete oxidation of methane on spinel oxides at a molecular level, Nature Communications, pp. 1-10, 2015.

Pecchi et al., Energy Production, Decontamination, and Hydrogenation Reactions over Perovskite-Type Oxide Catalyst, Perovskite Materials—Synthesis, Characterisation, Properties, and Applications, pp. 1-32, 2016.

Selnes, NiCo2O4 Catalyst on Commercial Low Surface Area and Synthesized High Surface Area CeO2 For Catalytic Methane Abatement in Natural Gas Engines, NTNU, pp. 1-129, Jun. 2020.

* cited by examiner

*Primary Examiner* — Ellen M McAvoy

(74) *Attorney, Agent, or Firm* — Maschoff Brennan

(57) ABSTRACT

The present invention relates to an additized blended fuel composition comprising of 97 to 50 weight % of liquified petroleum gas (LPG); 3 to 50 weight % of dimethyl ether (DME); and a nanocatalyst. More particularly, the present invention relates to an improvement in the combustion efficiency of the DME blended LPG fuel by using catalytic amount of the nano-catalyst, when introduced in ppm level enhances the combustion properties, thereby increasing the flame temperature and reducing the consumption of fuel gas mixture.

20 Claims, No Drawings

ADDITIZED DME/LPG FUEL FOR IMPROVING COMBUSTION EFFICIENCY

FIELD OF THE INVENTION

The present invention relates to a novel nanocatalyst based blended fuel composition. More specifically, the present invention provides a novel additized blended fuel composition comprising of LPG, DME and different in-house developed combustion improving nanocatalyst to improve the consumption behaviour of DME/LPG blended fuel in household cooking application.

BACKGROUND OF THE INVENTION

Due to growing concerns of global warming, energy efficient and environmentally friendly fuel has recently attracted much attention. Clean cooking is the main objective to reduce indoor air pollution, which also impacts human health. Liquefied petroleum gas (LPG) is a conventional fuel used for household and industrial cooking. The total LPG consumption is increasing year-by-year due to its increasing use in the industry and automobile sector as fuel in SI/CI engines. Thus, the gap between LPG availability and consumption is continuously growing. As a means for sustainable energy, since LPG is a mixture of C3/C4 alkanes, seeking for alternative fuel as a substitution for conventional household cooking fuel is needed for long-term energy conservation and to mitigate environmental concerns.

China has already identified dimethyl ether (DME) as a substitute blending fuel for LPG. DME is simple ether which can be produced from coal, biomass, natural gas, and methanol. The physical properties of DME are quite similar to LPG. DME is a non-toxic environment friendly gas, and it can be synthesized by simple Fischer-Tropsch synthesis, Therefore, DME has been identified as a suitable candidate for blending with LPG. Moreover, it does not have C—C bond, resulting in no soot formation during combustion. DME blended LPG in the bottled form would be the simplest way to penetrate the Indian fuel market with DME/LPG blend where there is a well-established bottled LPG supply system.

DME has the potential for application in various areas such as power generation, automotive fuel, domestic cooking fuel, and hydrogen source for fuel cells and as a feedstock for various chemicals [Semelsberger Troy A, Borup Rodney L, Greene Howard L. *Dimethylether (DME) as an alternative fuel, J Power Sources* 2006; 156.2:497-511. Erdener Hülya, Arinan Ayca, Orman Sultan. *Future fossil fuel alternative; DME (A review). Int J Renew Energy Res* 2012; 1(4):252-8]. DME may be used as a multidimensional fuel source. Several studies have been conducted on DME combustion and applications; however less attention has been paid to LPG and DME mixtures as a new alternative fuel for household purposes due to its low calorific value and higher fuel consumption.

Makmool et al. [Makmool U, Jugjai S. *Thermal efficiency and pollutant emissions of domestic cooking burners using DME-LPG blends as fuel*] investigated the performance of domestic cooking burner fired with DME-LPG blend on conventional burner and on porous radiant burner (PRB). Out of all the compositions used for the investigation, 25% blend was found optimum. However, on increasing DME concentration, a decrease in thermal efficiency was observed for conventional burners as well as PRB burners.

Anggarani et al. [Anggarani Riesta, Wibowo Cahyo S, Rulianto Dimitri. *Application of dimethylether as LPG substitution for household stove. Energy Procedia* 2014; 47: 227-34.] investigated the performance test of LPG mixed DME on existing LPG stove. He characterized the DME/LPG blends at the different concentrations of DME (5%, 10%, 15%, 20%, 25%, 30% and 50%) and determined the heat input of these blends, fuel efficiency, and flame stability. The study reiterated the fact that increasing the DME concentration decreases the thermal efficiency of the burner due to lesser calorific value of the composite fuel. The report emphasized on developing efficient burner for getting the optimum benefit of higher DME concentration in LPG.

A similar study on thermal efficiency of DME/LPG blends, as per Indian standard IS4246 was conducted at LERC (LPG Equipment Research Centre) India. This study also showed a decrease of 5.26% thermal efficiency while using a blend of 20% DME in LPG. Another study was conducted at CSIR-Indian Institute of Petroleum, Dehradun to observe the changes in thermal efficiency of a commonly used domestic LPG stove. They also observed a 5.26% decrease in thermal efficiency on using 20% DME blended LPG.

Though the challenge of low thermal efficiency of DME/LPG blended fuel has been tried to be addressed by the help of altering the burner design, which is tedious and impractical for application, no study is found to improve the combustion efficiency of the DME/LPG fuel blend to match the thermal efficiency of the burner used for neat LPG. Therefore, there is a requirement of suitable fuel composition with good combustion properties as an alternative to neat LPG, that could be efficiently utilized on commonly used domestic LPG burner stoves.

SUMMARY OF THE INVENTION

This summary is provided to introduce a selection of concepts, in a simplified format, that are further described in the detailed description of the invention. This summary is neither intended to identify key or essential inventive concepts of the invention and nor is it intended to determine the scope of the invention.

The present invention provides, an additized blended fuel composition comprising of:

i. 97 to 50 weight % of liquified petroleum gas (LPG);
ii. 3 to 50 weight % of dimethyl ether (DME); and
iii. a nanocatalyst, wherein the nanocatalyst is selected from metal quantum clusters, nano metal oxide, nano spinel oxide, and nano metal perovskite or a combination thereof; wherein the concentration of nanocatalyst is in the range of 5-60 ppm.

In one aspect, the invention provides the additized blended fuel composition, wherein:

- the metal quantum clusters are selected from quantum clusters of Ce, Fe, Cu, Al, Mn, Ni, Co, and Cr, preferably Ce or Fe quantum clusters;
- the nano metal oxide is selected from cerium oxide, aluminium oxide, manganese oxide, nickel oxide, cobalt oxides, preferably nano cerium oxide;
- the nano spinel oxide is selected from Ni/Co, Cu/Ni, Cu/Co, Cu/Al, Co/Al-oxide, preferably nano Ni/Co-oxide; and
- the nano metal perovskite is selected from lanthanum-calcium-manganese (LCM)-oxide ($La_{0.5}Ca_{0.5}MnO_3$) extended upto lanthanum-strontium-manganese (LSM) oxide, preferably lanthanum-calcium-manganese (LCM)-oxide perovskite.

In another aspect, the invention provides the additized blended fuel composition wherein, the metal quantum cluster is selected from quantum clusters Ce or Fe;

the nano metal oxide is nano cerium oxide;

the nano spinel oxide is nano Ni/Co-Oxide; and the nano metal perovskite is lanthanum-calcium-manganese (LCM)-oxide perovskite.

In another aspect, the invention provides the weight ratio of LPG to DME can be in the range of 1:1 to 32.33:1. In one of the preferred embodiments the weight ratio of LPG to DME is 3:1.

In another aspect, the invention provides the particle size of the nanocatalyst is in the range of 0.1 to 50 nm.

In another aspect, the invention provides the nanocatalyst is coated with a hydrocarbon compatible long chain polymer or an acid, wherein the hydrocarbon compatible long chain polymer is selected form polyamide, and polyimide and the acid is ethylhexanoic acid.

In yet another aspect, the invention provides the nanocatalyst is dispersed in a nonpolar solvent selected from hexane, pentane, terpentine oil, kerosene and heptane.

In one of the aspect, the invention provides the nanocatalyst comprises a combination of:

i. nano cerium oxide; and ii. nano Ni/Co oxide, wherein the concentration of nano cerium oxide is 40 ppm, and the concentration of nano Ni/Co oxide is 10 ppm.

In another aspect, the invention provides the nanocatalyst is homogenously dispersed in the blended fuel.

The present invention provides, a process for preparing the additized blended fuel composition comprising:

(i) adding nanocatalyst dispersion to the empty pressure vessels; and (ii) filling with LPG and DME under pressure to form additized blended fuel composition.

The present invention also provides a fuel burning article containing the additized blended fuel composition.

OBJECTIVES OF THE PRESENT INVENTION

It is a primary objective of the present invention to develop an additized DME/LPG blended fuel composition with improved combustion efficiency.

Another objective of the present invention is to provide different nano Fuel Borne Catalysts (FBC) individually or in combination to improve the combustion properties of additized DME/LPG blended fuel composition.

Further objective of the invention is to utilize the specifically developed additized DME/LPG blended fuel composition in household cooking application in regular LPG burner stoves.

Abbreviations

DME: Dimethyl ether

LPG: Liquified petroleum gas

FCB: Fuel borne catalyst

RPM: Rotation per minute

DETAILED DESCRIPTION OF THE INVENTION

For the purpose of promoting an understanding of the principles of the invention, reference will now be made to the embodiments in the specific language will be used to describe the same. It will nevertheless be understood that no limitation of the scope of the invention is thereby intended, such alterations and further modifications in the illustrated composition, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which this invention belongs. The composition, methods, and examples provided herein are illustrative only and not intended to be limiting.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

Throughout this specification, unless the context requires otherwise the word "comprise", and variations such as "comprises" and "comprising", will be understood to imply the inclusion of a stated element or step or group of element or steps but not the exclusion of any other element or step or group of element or steps.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods and materials are now described. All publications mentioned herein are incorporated herein by reference.

The terminology and structure employed herein is for describing, teaching, and illuminating some embodiments and their specific features and elements and does not limit, restrict, or reduce the spirit and scope of the invention.

Accordingly, the present invention provides an additized blended fuel composition comprising of DME, LPG and different nano Fuel Borne Catalysts (FBC) individually or in combination to improve the consumption of DME/LPG blended fuel.

In one of the embodiments of the invention, the fuel borne catalysts (FBC) are basically metal oxo/hydroxo complexes stabilized by long-tail organic ligands. The inorganic content is in-situ transformed during the combustion process inside the flame and catalyzes the hydrocarbon (HC) combustion process. The main advantage of the FBC is an effective dynamic intermingling of the nascent particles of the catalyst and HC vapour in a gas phase which is beneficial for increasing the number of their mutual contact points. As a result, the oxygen transfer from the catalyst towards the hydrocarbon fuel is facilitated, enhancing the combustion process.

In another embodiment, the invention provides that various catalysts have been used for liquid fuels like diesel to decrease the soot formation during diesel combustion. An ideal catalyst would lower the combustion temperature of soot (i.e., activation energy) and allow clean exhaust and decrease emission. Whereas, in gaseous fuel catalyst primarily increases the flame temperature of gaseous fuel during combustion of fuel through loop combustion mechanism. They allow complete and instantaneous combustion resulting in high flame temperature and efficiency.

In another embodiment, the invention provides the catalyst required for DME/LPG blended fuel to be competent enough to improve the combustion of LPG as well as DME. Breaking of C—C bond at high temperature for C3/C4 alkanes takes a lot of flame energy to create $CH_3$ radical. LPG Combustion catalysts initiate breaking of C—C bond at high temperature and provide Loop combustion in flame zone. In case of DME decomposition there is no C—C bond breakage. Intermediate products are $CH_3$, CO, and $H_2$ which take part in combustion to produce $CO_2$ & $H_2O$. Nanocatalyst catalyses the formation of $CH_3$ radical for enhanced combustion at comparatively low temperature was found very useful in this particular mixture of fuel. Ce and Fe based catalysts were chosen as combustion improver mainly for LPG. Keeping in mind the methane combustion, spinel oxide catalyst was also used individually as well as in combination with Ce catalyst. Spinel oxide, a type of reducible early transition metal oxide, consists of $M^{2+}$ and $M^{3+}$ sites in its lattice. $Co_3O_4$ is one of the spinel oxides which has almost the weakest M—O bonds among all transition metal oxides. Oxygen vacancies can be readily generated even at a temperature below 25° C. Additionally, the barrier for hopping oxygen vacancies is very low i.e., only 0.23 eV, hence abundant reactive oxygen species are present on the surface of $Co_3O_4$. It is well known that insertion of heterometal atoms such as Ce, Ni, Zn, Cr, etc. into the spinel structure $Co_3O_4$ is an effective way to induce lattice distortion, which could further enhance the portion of active surface oxygen and boost the redox properties. Due to the high density of oxygen vacancies on the surface of $Co_3O_4$, foreign metal cations and oxygen vacancies can be mixed at atomic scale and integrated to the lattice $Co_3O_4$ through formation of a doped spinel oxide $M_xCo_{3-x}O_4$. These spinel oxides can activate oxygen at low temperature and completely oxidize the methane in the temperature range of 350-550° C. Mechanistic study suggests that below 450° C., a suprafacial Langmuir-Hinshelwood mechanism dominates with oxygen species activated on tetrahedral sites (CoT). However, at temperature 450° C. or higher the Mars van Krevelen mechanism on interfacial Co—O surface sites takes place, where lattice oxygen will directly participate for methane oxidation.

In another embodiment, the present invention provides the use of metal, metal oxide and perovskite based catalysts for improving the combustion efficiency of DME/LPG blend. Metal based catalysts are mainly Ce and Fe compounds, but it can be extended to other metal based catalysts like Cu, Al, Mn, Ni, Co, Cr etc. Similarly, the primary metal oxide used as catalyst is cerium oxide and NiCo-oxide (SPINEL). Other metal oxides like copper oxide, aluminium oxide, manganese oxide, nickel oxide, cobalt oxides, etc. also have similar catalytic property. Other SPINEL materials like Cu/Ni, Cu/Co, Cu/Al, Co/Al-oxide, etc. are also potential catalysts for combustion improvement of DME/LPG blend. Apart from these, Lanthanum-Calcium-Manganese (LCM)-oxide ($La_{0.5}Ca_{0.5}MnO_3$) as perovskite material was also used as combustion improving catalyst for DME/LPG blend. The perovskite material based catalyst is not only limited to LCM but it can be extended upto Lanthanum-Strontium-Manganese (LSM) oxide, etc., with selection of suitable dopants for A and B site.

In another embodiment, the present invention provides the measurement of flame temperature of the base DME/LPG blend and additized blends at different concentrations. The said catalyst or catalyst mixture is homogeneous in nature. The homogeneity and stable dispersion of the catalysts enhance the combustion effectively. If the catalyst is not homogenously dispersed, the catalysts will settle down from the liquid medium. This would result in intermittent or non-availability of the catalysts at combustion point.

The present invention provides, an additized blended fuel composition comprising of:

i. 97 to 50 weight % of liquified petroleum gas (LPG);
ii. 3 to 50 weight % of dimethyl ether (DME); and
iii. a nanocatalyst, wherein weight % is based on the total weight of the composition, wherein the nanocatalyst is selected from metal quantum clusters, nano metal oxide, nano spinel oxide, and nano metal perovskite or a combination thereof; wherein the concentration of nanocatalyst is in the range of 5-60 ppm.

In one feature of the present invention, the additized blended fuel composition, wherein

- the metal quantum clusters are selected from quantum clusters of Ce, Fe, Cu, Al, Mn, Ni, Co, and Cr, preferably Ce or Fe quantum clusters;
- wherein the nano metal oxide is selected from cerium oxide, aluminium oxide, manganese oxide, nickel oxide, cobalt oxides, preferably nano cerium oxide;
- the nano spinel oxide is selected from Ni/Co, Cu/Ni, Cu/Co, Cu/Al, Co/Al-oxide, preferably nano Ni/Co-Oxide; and
- wherein the nano metal perovskite is selected from lanthanum-calcium-manganese (LCM)-oxide ($La_{0.5}Ca_{0.5}MnO_3$) extended upto lanthanum-strontium-manganese (LSM) oxide, preferably lanthanum-calcium-manganese (LCM)-oxide perovskite.

In another feature of the present invention, the additized blended fuel composition wherein,

- the metal quantum cluster is selected from quantum clusters Ce or Fe; the nano metal oxide is nano cerium oxide,
- the nano spinel oxide is nano Ni/Co-Oxide; and
- the nano metal perovskite is lanthanum-calcium-manganese (LCM)-oxide perovskite.

In another feature of the present invention, the weight ratio of LPG to DME of the additized blended fuel composition is in the range of 1:1 to 32.33:1. In one of the preferred features, the weight ratio of LPG to DME is 3:1.

In another word, the weight ratio of LPG to DME of the additized blended fuel composition can be in the range of 50:50 to 97:3. Preferably, the weight ratio of LPG to DME is 75:25.

In another feature of the present invention, the size of the nanocatalyst is in the range of 0.1 to 50 nm.

In another feature of the present invention, the nanocatalyst is coated with a hydrocarbon compatible long chain polymer or an acid, wherein the hydrocarbon compatible long chain polymer is selected form polyamide, and polyimide and the acid is ethylhexanoic acid.

In another feature of the present invention, the nanocatalyst is dispersed in a nonpolar solvent selected from hexane, pentane, terpentine oil, kerosene and heptane etc.

In another feature of the present invention provides, the nanocatalyst comprises a combination of:

(i) nano cerium oxide; and
(ii) nano Ni/Co oxide, wherein the concentration of nano cerium oxide is 40 ppm, and the concentration of nano Ni/Co oxide is 10 ppm.

In yet another feature of the present invention, the nanocatalyst is homogenously dispersed in the blended fuel.

The present invention provides, a process for preparing the additized blended fuel composition comprising:

(i) adding nanocatalyst dispersion to the empty pressure vessels; and
(ii) filling with LPG and DME under pressure to form additized blended fuel composition.

The present invention also provides a fuel burning article containing the additized blended fuel composition.

Flame Temperature Study:

This method covers measurement of flame temperature of an open flame on an LPG gas burner. The use of this method aims at ascertaining the presence of catalyst in differentiated LPG cylinder by measuring the enhancement in flame temperature (FT) on a domestic stove.

Equipments for Test:

Domestic Two burners Stove (IS marked)
Type 'K' rigid Thermocouple
Digital Data logger
Clamp and Stand for holding thermocouple
Gas lighter
LPG Cylinder Procedure for Flame Temperature Study:

The thermocouple should be connected to the data logger before starting measurement. The Flame must be generated on a domestic stove in a suitable place to avoid drift/flow of wind that may disturb the flame sturdiness. The cleanliness of the burner must be ensured before flame generation.

The thermocouple position is set horizontally at a specific height from the outer edge of the burner nozzle (hole) of outer circle using clamp and stand. The flame on the burner is turned on and set at max position of knob. The thermocouple position is adjusted at the outer edge of the blue flame very minutely to get the highest temperature. The data is recorded when the temperature stabilizes within ±5° C. Putting thermocouple for longer time in the flame may damage it.

Burner is turned off and the data logger is switched off. The thermocouple and burner are allowed to cool down to ambient temperature before starting any fresh measurement.

The procedure is adopted for LPG, DME/LPG and additized DME/LPG blend.

Fuel Consumption Study:

A fuel consumption study is performed with neat LPG, 25% DME blended LPG, and catalyst additized 25% DME blended LPG.

Materials for Experiment Set Up:

One ISO approved LPG gas stove
One thermocouple (preferably Type 'K')
A data logger for measuring data continuously against time in covering temperature range from ambient to 300° C.
One overhead stirrer made of polytetrafluoroethylene (PTFE)
Flat bottom pans (Steel) with lid having two holes (one for stirrer and other for thermocouple). These pans should cover the flame of the burner completely for better heat transfer.

Procedure for Fuel Consumption Study:

First, the weight of a pan with lid is measured. Then a specific amount of oil is taken n a pre-weighed pan suitable for respective burners and the weight is measured again.

The LPG cylinder is fixed to the stove and the LPG cylinder regulator is connected. The initial weight of LPG cylinder with regulator and the tube is taken as the reference.

The pan with oil is put on the burner; the stirrer and thermocouple are fixed through the holes in lid of the pan, marking both for depth of insertion in oil. The stirrer and data logger are switched on and stirring is done at low RPM to avoid any heat loss and spillage.

The stove knob is switched on and the LPG is ignited simultaneously. The knob is fixed to the maximum position.

Heating of the oil with constant stirring is done till temperature reaches at a pre-defined temperature and then the stove knob is switched off immediately after the temperature is reached.

The final weight of the LPG cylinder with regulator and tube (reference) is noted immediately after the test without disturbing any set up.

The exercise with reference LPG is repeated at least 3 times and every time fresh oil is taken.

After this, the same exercise is repeated 3 times by replacing the LPG cylinder with candidate LPG cylinder, keeping other points same as with reference LPG. Average reading of the three data points is taken for calculation of the difference in gas consumption.

EXAMPLES

The present disclosure with reference to the accompanying examples describes the present invention. However, those of skill in the art should, in light of the present disclosure, appreciate that many changes can be made in the specific embodiments which are disclosed and still obtain a like or similar result without departing from the spirit and scope of the invention. It is understood that the examples are provided for the purpose of illustrating the invention only and are not intended to limit the scope of the invention in any way.

Example 1: Flame Temperature of Additized Gas Blend

The gas blend composition and the concentration of the nanocatalyst used is given in table 1. Measured Flame temperature of neat LPG, base DME/LPG blend and additized DME/LPG blend is given in table 2.

TABLE 1

Gas blends and Catalyst concentration

| Gas Blend Composition* (Wt. %) | | Nano-Catalysts considered | |
|---|---|---|---|
| $C_3/C_4$ | DME* | Type | Conc. In ppm |
| 100 | 0 | — | |
| 75 | 25 | — | |
| 75 | 25 | A | 10 |
| | | A | 40 |
| 75 | 25 | B | 10 |
| 75 | 25 | C | 10 |
| 75 | 25 | D | 10 |
| 75 | 25 | E | 10 |
| 75 | 25 | A:E | 5:5 |
| | | | 10:10 |
| | | | 40:10 |
| | | | 40:20 |
| | | | 50:10 |

A: Nano Cerium Oxide
B: Cerium Quantum Cluster
C: Iron Quantum Cluster
D: LCM (Perovskite)
E: Nano NiCo-Oxide
A:E: Combination of catalyst A and E.

TABLE 2

Flame temperature of neat LPG, base DME/LPG blend and additized DME/LPG blend

| Fuel used | Nanocatalyst | Concentration of Catalyst (ppm) | Flame Temp range (° C.) |
|---|---|---|---|
| LPG | NIL | 0 | 880-885 |
| 25% DME + | NIL | 0 | 885-890 |
| 75% LPG | A | 10 | 910-915 |
| | A | 40 | 900-905 |
| | B | 10 | 910-915 |
| | C | 10 | 910-915 |
| | D | 10 | 905-910 |
| | E | 10 | 900-905 |
| | A:E | 5:5 | 890-895 |
| | A:E | 10:10 | 910-915 |
| | A:E | 40:10 | 910-915 |
| | A:E | 40:20 | 910-915 |
| | A:E | 50:10 | 910-915 |

First, the flame temperature of neat LPG is measured and found in the range of 880-885° C. Then, 25% DME is blended with LPG and flame temperature is measured. The flame temperature of un-additized DME blended LPG is found in the range of 885-890° C. In the next step, different catalysts are added in the 25% DME blended LPG in different concentrations and corresponding flame temperatures are measured. By using nanocatalysts, flame temperature of DME blended LPG is increased by 30° C. as compared to neat LPG.

Example 2: Gas Consumption Study with LPG, DME/LPG (25:75) and Additized DME/LPG (25:75)

Gas consumption studies are performed with neat LPG, base DME/LPG blend and additized DME/LPG blend. The details of the results are depicted in Table 3 and 4.

TABLE 3

Gas consumption studies using individual catalyst in DME/LPG blend

| Fuel used | Nanocatalyst | Catalyst Conc. (ppm) | Average Gas Consumption (g) Big burner |
|---|---|---|---|
| LPG | NIL | NIL | 42.37 ± 0.45 |
| 25% DME + | NIL | NIL | 51.63 ± 0.79 |
| 75% LPG | A | 10 | 47.83 ± 0.60 |
| | A | 40 | 46.47 ± 0.50 |
| | B | 10 | 49.80 ± 0.90 |
| | C | 10 | 51.43 ± 0.55 |
| | D | 10 | 48.13 ± 0.05 |
| | E | 10 | 47.77 ± 0.55 |

TABLE 4

Gas consumption study with mixed catalyst additized DME/LPG (25:75)

| Fuel used | Nanocatalyst | Combination Catalyst Concentration (ppm) | Average Gas Consumption (g) Big burner |
|---|---|---|---|
| LPG | NIL | NIL | 42.37 ± 0.45 |
| 25% DME + | NIL | NIL | 51.63 ± 0.79 |
| 75% LPG | A:E | 5:5 | 51.83 ± 0.1 |
| | A:E | 10:10 | 48.90 ± 1.05 |
| | A:E | 40:10 | 45.23 ± 0.40 |

TABLE 4-continued

Gas consumption study with mixed catalyst additized DME/LPG (25:75)

| Fuel used | Nanocatalyst | Combination Catalyst Concentration (ppm) | Average Gas Consumption (g) Big burner |
|---|---|---|---|
| | A:E | 40:20 | 45.33 ± 0.45 |
| | A:E | 50:10 | 45.27 ± 0.35 |

It is observed that addition of DME leads to increased gas consumption compared to neat LPG. On addition of different nanocatalysts, it is clearly observed that the fuel combustion is changed in a significant manner Different nanocatalysts behave differently in DME/LPG blends. Performance of nanocatalyst A and E is seen marginally better than other catalysts B, C and D. Interestingly when combination of catalysts is used, the improvement in the combustion efficiency is found highest, showing synergistic behavior between A and E combustion catalysts.

Example 3: Study of $CO/CO_2$ Ratio $CO/CO_2$ ratio during burning of fuels is measured as per IS4246. It is observed that for LPG, the $CO/CO_2$ ratio is 0.0129. But after 25% DME blending the ratio is reduced to 0.00098. On addition of mixed catalyst in 40:10 ratio the $CO/CO_2$ ratio is further reduced to 0.00042 as shown in table 5.

TABLE 5

Emission study with neat LPG and additized DME/LPG blend

| Gas Blend | Ratio $CO/CO_2$ Big Burner |
|---|---|
| LPG (100%) | 0.0129 |
| 25% DME + 75% LPG + AE (40:10) | 0.00042 |
| 25% DME + 75% LPG + AE (05:05) | 0.00087 |
| 25% DME + 75% LPG + AE (40:20) | 0.00051 |
| 25% DME + 75% LPG + AE (50:10) | 0.00049 |
| 25% DME + 75% LPG | 0.00098 |

The present invention provides the following advantage over the prior arts:

- Improves the combustion efficiency of DME/LPG mixture, thereby reducing its consumption.
- Optimizes the specific roles of catalysts for individual combustion of DME and LPG.
- Optimized combination of both types of catalyst has the maximum benefit as it can improve the combustion of LPG and DME both.
- Using combustion improving catalyst rules out the complexity of modification in burner engineering part.
- The flame temperature of DME/LPG mixture fuel can be increased using catalysts or their combination.

The invention claimed is:

1. An additized blended fuel composition comprising:
97 to 50 weight % of liquified petroleum gas (LPG);
3 to 50 weight % of dimethyl ether (DME); and
a nanocatalyst,
wherein the nanocatalyst is selected from the group consisting of a metal quantum cluster, a nano metal oxide, a nano spinel oxide, and a combination thereof; wherein the nanocatalyst has a concentration in a range of 5-60 ppm.

2. The additized blended fuel composition of claim 1, wherein the metal quantum cluster is selected from the group consisting of Ce, Fe, Cu, Al, Mn, Ni, Co, and Cr; the nano metal oxide is selected from the group consisting of cerium oxide, aluminium oxide, manganese oxide, nickel oxide, and cobalt oxide; the nano spinel oxide is selected from the group consisting of Ni/Co, Cu/Ni, Cu/Co, Cu/Al, and Co/Al-oxide.

3. The additized blended fuel composition of claim 2, wherein the metal quantum cluster is Ce or Fe;

the nano metal oxide is nano cerium oxide; and the nano spinel oxide is nano Ni/Co-Oxide.

4. The additized blended fuel composition of claim 1, wherein LPG and DME are in a weight ratio in a range of 1:1 to 32.3:1.

5. The additized blended fuel composition of claim 4, wherein LPG and DME are in a weight ratio of 3:1.

6. The additized blended fuel composition of claim 1, wherein the nanocatalyst has a particle size in a range of 0.1 to 50 nm.

7. The additized blended fuel composition of claim 1, wherein the nanocatalyst is coated with a hydrocarbon compatible long chain polymer or an acid, wherein the hydrocarbon compatible long chain polymer is polyamide, or polyimide, and the acid is ethylhexanoic acid.

8. The additized blended fuel composition of claim 1, wherein the nanocatalyst is dispersed in a nonpolar solvent selected from the group consisting of hexane, pentane, terpentine oil, kerosene, and heptane.

9. The additized blended fuel composition of claim 1, wherein the nanocatalyst comprises a combination of the nano metal oxide, and the nano spinel oxide; the nano metal oxide is nano cerium oxide, and the nano spinel oxide is nano Ni/Co oxide; the nano cerium oxide has a concentration of 40 ppm, and the nano Ni/Co oxide has a concentration of 10 ppm.

10. The additized blended fuel composition of claim 1, wherein the nanocatalyst is homogenously dispersed in the additized blended fuel composition.

11. The additized blended fuel composition of claim 1, wherein the additized blended fuel composition on ignition has a flame temperature in a range of 885-915° C.

12. The additized blended fuel composition of claim 1, wherein the additized blended fuel composition on ignition produces $CO/CO_2$ in a ratio in a range of 0.0004 to 0.001.

13. A fuel burning article comprising the additized blended fuel composition of claim 1.

14. A process for preparing an additized blended fuel composition, the process comprising:

adding a nanocatalyst dispersion to an empty pressure vessel; and filling the empty pressure vessel with liquified petroleum gas (LPG) and dimethyl ether (DME) under a pressure to form the additized blended fuel composition.

15. The process of claim 14, wherein the additized blended fuel composition comprises 97 to 50 weight % of liquified petroleum gas (LPG), 3 to 50 weight % of dimethyl ether (DME), and a nanocatalyst; the nanocatalyst is selected from the group consisting of a metal quantum cluster, a nano metal oxide, a nano spinel oxide, and a combination thereof, wherein the nanocatalyst has a concentration in a range of 5-60 ppm.

16. The process of claim 15, wherein the metal quantum cluster is selected from the group consisting of Ce, Fe, Cu, Al, Mn, Ni, Co, and Cr; the nano metal oxide is selected from the group consisting of cerium oxide, aluminium oxide, manganese oxide, nickel oxide, and cobalt oxide; the nano spinel oxide is selected from the group consisting of Ni/Co, Cu/Ni, Cu/Co, Cu/Al, and Co/Al-oxide.

17. The process of claim 16, wherein the metal quantum cluster is Ce or Fe; the nano metal oxide is nano cerium oxide; the nano spinel oxide is nano Ni/Co-Oxide.

18. The process of claim 14, wherein the nanocatalyst comprises a combination of the nano metal oxide, and the nano spinel oxide; the nano metal oxide is nano cerium oxide, and the nano spinel oxide is nano Ni/Co oxide; the nano cerium oxide has a concentration of 40 ppm, and the nano Ni/Co oxide has a concentration of 10 ppm.

19. The process of claim 14, wherein LPG and DME are in a weight ratio in a range of 1:1 to 32.3:1.

20. The process of claim 19, wherein LPG and DME are in a weight ratio of 3:1.

* * * * *